United States Patent [19]

Pardi

[11] Patent Number: 4,844,477

[45] Date of Patent: Jul. 4, 1989

[54] GAME NET ASSEMBLY

[75] Inventor: Edward Pardi, Madison, Conn.

[73] Assignee: Jayfro Corporation, Waterford, Conn.

[21] Appl. No.: 239,546

[22] Filed: Sep. 1, 1988

[51] Int. Cl.[4] ..... A63B 61/04; B25B 25/00

[52] U.S. Cl. ..... 273/29 BD; 24/68 CD; 273/29 BE; 273/411

[58] Field of Search ..... 273/411, 29 BC, 29 BD, 273/29 BE, 29 B; 24/68 CD

[56] References Cited

U.S. PATENT DOCUMENTS

| | | | |
|---|---|---|---|
| 2,889,136 | 6/1959 | Prete | 74/156 X |
| 3,961,789 | 6/1976 | Tabacheck | 273/29 BE |
| 4,154,427 | 5/1979 | Hoffmann | 24/68 CD |
| 4,185,360 | 1/1980 | Prete, Jr. et al. | 24/68 CD |
| 4,253,671 | 3/1981 | Pace | 273/411 |
| 4,324,022 | 4/1982 | Prete, Jr. | 24/68 CD |
| 4,324,023 | 4/1982 | Prete, Jr. | 24/68 CD |
| 4,415,163 | 11/1983 | Schoenig | 273/29 BC X |
| 4,444,397 | 4/1984 | Kaburagi et al. | 273/411 |
| 4,510,651 | 4/1985 | Prete, Jr. et al. | 24/68 CD X |
| 4,717,157 | 1/1988 | Smith | 273/411 |

*Primary Examiner*—William H. Grieb

*Attorney, Agent, or Firm*—Kane, Dalsimer, Sullivan, Kurucz, Levy, Eisele and Richard

[57] ABSTRACT

A game net assembly, useful for example in playing lawn tennis, badminton, volleyball or like games is described as including a ratchet buckle for applying necessary tensions to the net.

4 Claims, 3 Drawing Sheets

GAME NET ASSEMBLY

BACKGROUND OF THE INVENTION

1. Field of the Invention

The invention relates to apparatus for use in sports activity and more particularly to game net assemblies.

2. Brief Description of the Prior Art

Athletic games such as lawn tennis, badminton, volleyball and the like are played using a game net. The rules of the particular game generally specify the structure and disposition of the game net.

For example, lawn tennis, the invention of Walter Clopton Wingfield (British Patent Specification No. 685, Feb. 23, 1874) is now played according to the rules of the United States Tennis Association.

Rule 1 specifies in part that:

"Dimensions and Equipment

The court shall be a rectangle 78 feet (23.77 meters) long and 27 feet (8.23 meters) wide. It shall be divided across the middle by a net suspended from a cord or metal cable of a maximum diameter of one-third of an inch (0.8 centimeters), the ends of which shall be attached to, or pass over, the tops of two posts, 3 feet 6 inches (1.07 meters) high, and not more than 6 inches (15 centimeters) in diameter, the centers of which shall be 3 feet (0.91 meters) outside the court on each side.

The net shall be extended fully so that it fills completely the space between the two posts and shall be of sufficiently small mesh to prevent the ball's passing through. The height of the net shall be 3 feet (0.914 meters) at the center where it shall be held down taut by a strap not more than 2 inches (5 centimeters) wide and white in color.

There shall be band covering the cord or metal cable and the top of the net for not less than 2 inches (5 centimeters) nor more than 2½ inches (6.3 centimeters) in depth on each side and white in color. There shall be no advertisement on the net, strap, band or singles sticks."

It will be appreciated that ideally the erected rectangular net will have a substantially straight suspending cable, so that the net is fairly uniform in its height above the court surface, for the entire distance between posts. It will also be appreciated that considerable tension must be applied to the suspending cable to overcome the weight and length of the net, if the ideal is to be achieved. Heretofore, this tension has been applied by a variety of means, usually by the aid of a small winch attached to the end of the suspending cable and mounted on one of the posts. The use of a winch means is not completely satisfactory for all circumstances. For example, they require a degree of muscle power to operate, not always possessed by children or young players. Also, if released while the cable is under tension, the winch handle can become a safety hazard to the operator. In addition, the use of a winch can cause a twisting of the round suspender cable, resulting in a kinking and fraying of the cable.

The tennis net assembly of the present invention is an improvement in the art, obviating the above-described faults of the prior art assemblies.

The present invention has particular advantages when applied to volleyball nets. Volleyball is currently played according to rules established by the U.S. Volleyball Association. According to the rules, the net is 3′ wide and 32′ long, with 4″ square mesh construction. Rules require a 2″ white or orange band at the top of the net with a ¼″ cable running through the band. Some nets are fastened to referees' stands, some to standards, and others are fastened directly to a wall. It is important that the net be stretched tightly between the uprights. Rules require that no more than ¼″ sag is allowed, so a strong tightening device is needed. Also, in contrast to the game of tennis it is preferred that the volleyball net be tensioned in a horizontal plane at both top and bottom margins and also in a vertical direction. These requirements for tensioning have raised particular problems which the prior art artisans have addressed extensively. Representative of the descriptions given in the prior art are those found in the following U.S. Patents.

The U.S. Pat. No. 4,253,671 (Pace) describes a pole structure for supporting a volleyball net and includes a complex net tension adjusting device. The tension adjusting device includes elastomeric yarns, ultimately anchored to the earth.

U.S. Pat. No. 4,415,163 (Schoenig) concerns a portable volleyball net suspension system which also includes resilient (elastomeric) components to apply tension to the erected net. This system differs essentially from that described in U.S. Pat. No. 4,717,157 (Smith) wherein elastomeric stretch cords are used as ties to secure the net to standards and thereby apply tension to the secured net.

The U.S. Pat. No. 4,444,397 (Kaburogi et al.) describes a volleyball net suspending system which includes telescoping pole standards to adjust the net height. Within the pole is a winch which is attached to and receives an end of the net suspending cable. Adjustment of the cable tension is affected by cranking the winch device to take up slack in the cable. No provision is made for vertical or bottom margin tension.

The prior art methods and means for applying tension to a volleyball net are only partially satisfactory. The use of elastomeric cords or components have limitations, being affected by temperature, humidity, exposure to sunlight, permanent deformation under stress and elastic life. More importantly, the prior art means and methods of applying tension to the net are not fail-safe and can fail to maintain a uniform, proper tension during periods of use.

The volleyball net assembly of the present invention provides easy and fail-safe official net heights, eliminates cable kinking and reduces fraying of the support cable.

SUMMARY OF THE INVENTION

The invention comprises a game net assembly, which comprises;

a net adapted by size and configuration to meet the requirements of play in a ball game, said net having a top edge, a bottom edge, a first side edge and a second side edge, said side edges being spaced apart from each other and joining the top edge to the bottom edge;

a headband attached to the top edge and extending between the first and the second side edges;

a net support cable disposed on a substantially horizontal axial plane and secured to the top edge of the net, said cable having a first end and a second end;

a first upright support positioned adjacent to the first side edge of the net, said upright support having a first end anchored to a support surface and a free second end;

the first end of the support cable being secured to the free end of the first upright support;

a second upright support positioned adjacent to the second side edge of the net, said second upright support having a first end anchored to a support surface and a second end;

a ratchet buckle mounted on the second upright support and coupled to the support cable second end, by the strap component of the ratchet buckle;

said ratchet buckle comprising a frame member with a pair of oppositely positioned arms;

a reel member rotatably supported between said arms;

a pair of ratchet wheels being rotatably mounted between said arms and fixedly attached to said reel member in spaced apart relationship;

a latching plate slidably mounted between said arms for latching said ratchet wheels when they are not being rotatably driven, the strap being wound around said reel member;

a lever member having a pair of oppositely positioned arms rotatably mounted on the reel member; and a ratchet drive plate slidably mounted between the lever member arms which engages and drives said ratchet wheel when the lever member is actuated.

DETAILED DESCRIPTION OF THE PREFERRED EMBODIMENTS OF THE INVENTION

Figure 1:
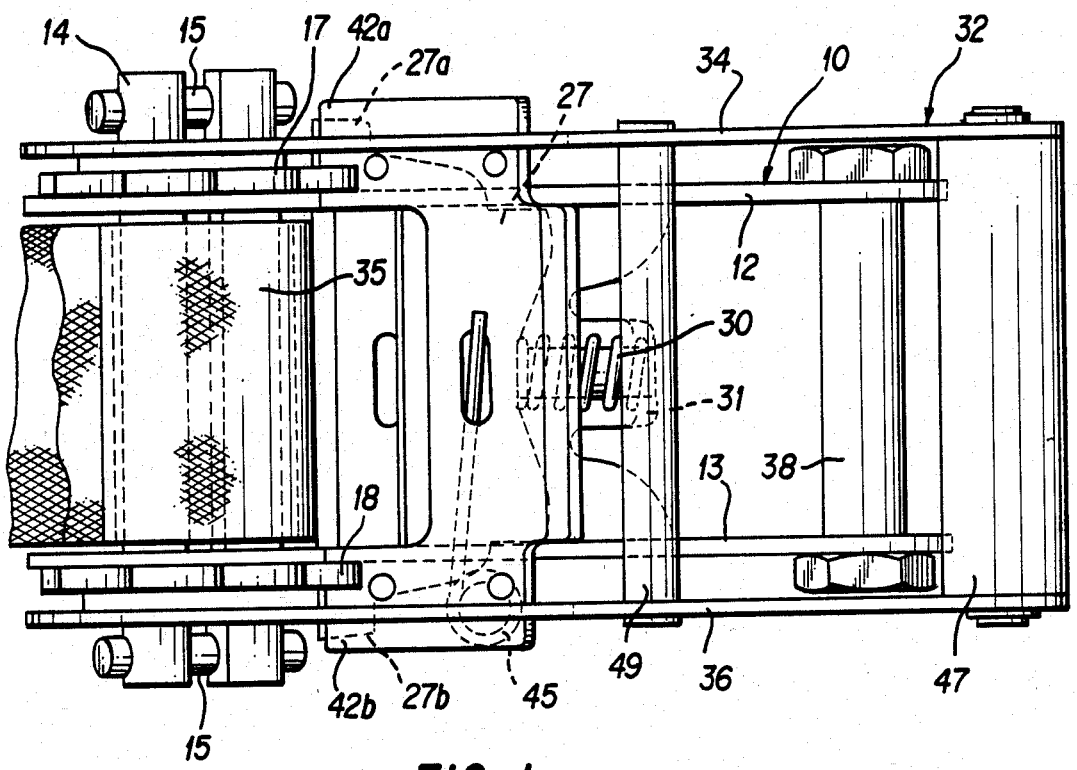
FIG. 1 is a top plan view of a ratchet buckle used in a preferred embodiment of the invention.

Those skilled in the art will gain an appreciation of the invention from the following description of the preferred embodiments, when read in conjunction with a viewing of the accompanying drawings of FIGS. 1–5, inclusive.

An essential component of the assembly of the invention is at least one ratchet buckle. Ratchet buckles are generally well known articles of manufacture, although the commercially available devices vary widely in their particular construction and operation. The preferred ratchet buckles for use in the present invention are described for example in the U.S. Pat. Nos. 2,889,136; 4,185,360; 4,324,023; and 4,510,651. In general, these preferred ratchet buckles have the construction shown in the accompanying drawings of FIGS. 1-4. As shown in these Figures, the preferred rachet buckle 10 includes a bifurcated frame member 11 which has a pair of oppositely positioned parallel arms 12 and 13. Reel member 14 is formed from a pair of bars which are joined together at their end portions by means of pins 15, and is rotatably mounted on frame 11 between arms 12 and 13. Mounted on reel 14 in fixed positions relative thereto are a pair of ratchet wheels 17 and 18, these ratchet wheels having web portions 20 which run between the bars of reel 14 and thus prevent rotation of the wheels relative to the reel.

Mounted for longitudinal motion in slots 25 shaped in arms 12 and 13 of the frame is a latching plate 27. Latching plate 27 is undercut to form a pair of arm portions **27*a* and 27*b* and latching surfaces 27*c* facing substantially opposite to the direction in which the plate 27 extends into the ratchet wheels 17 and 18. Latching plate 27 is slidably urged by means of spring 30 which abuts at one end thereof against bracket 31 formed in the frame and at the other end against the body of the latching plate. This spring action forces the ends of arm portions 27*a* and 27*b* against ratchet wheels 17 and 18 and holds the wheels in a latched condition at times other than when lever member 32 is being lifted away from frame member 11**.

Figure 2:
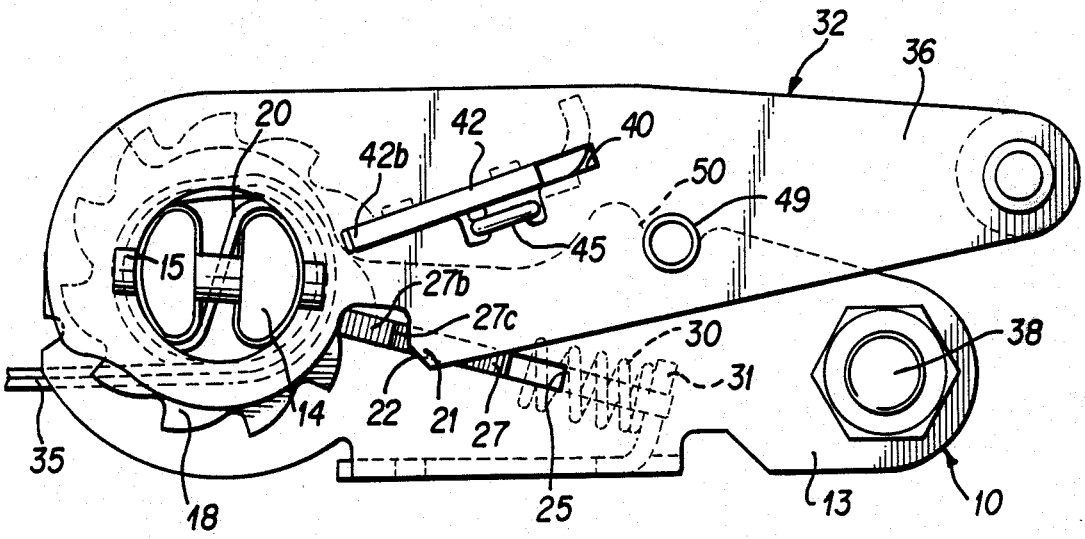
FIG. 2 is a side elevational view of the ratchet buckle shown in FIG. 1.
Figure 3:
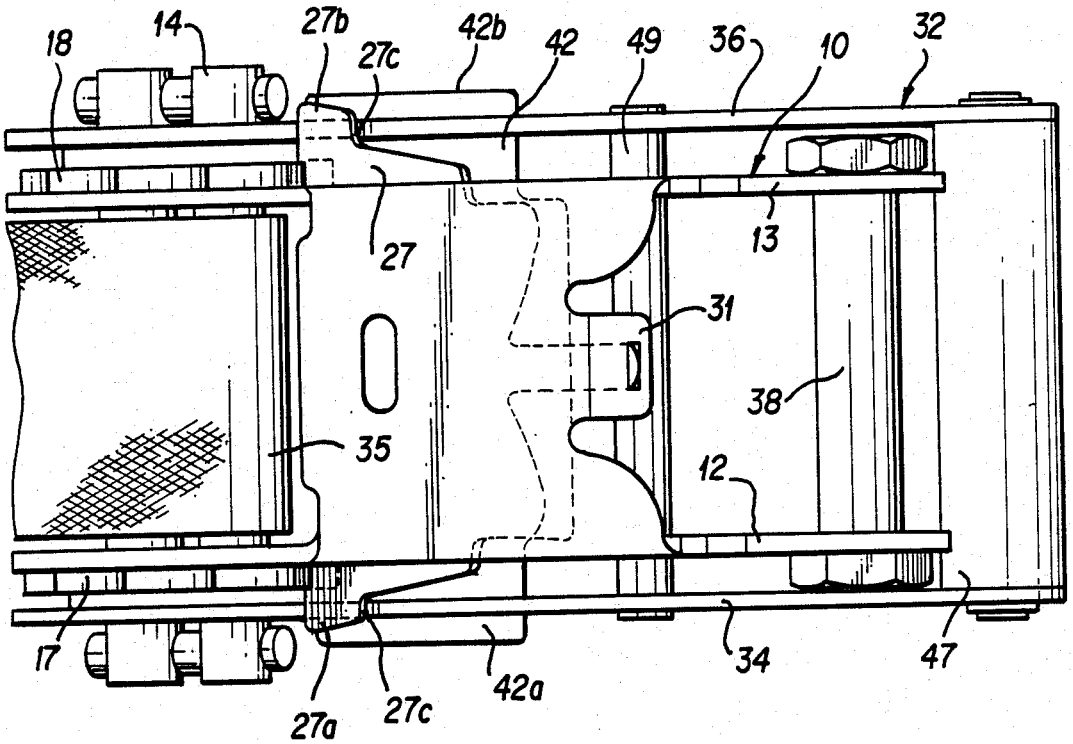
FIG. 3 is a bottom plan view of the ratchet buckle shown in FIG. 1.

A strap member 35 to be tensioned has a first end attached to the load (a support cable of the assembly of the invention) and a second end wound around reel 14 as lever member 32 is raised and lowered relative to frame 11. A bar member 38 runs between arms 12 and 13 and is fixedly attached or anchored to a member relative to which the strap 35 is to be tensioned, as for example the net support post of a game net. Lever member 32 has a pair of oppositely positioned parallel arms 34 and 36, these arms being rotatably supported in reel 14 between ratchet wheels 17 and 18 and pins 15. Slidably mounted in elongated slot 40 shaped in arms 34 and 36 is a ratchet drive plate 42, this plate having a pair of arms **42*a* and 42*b* which engage ratchet wheels 17 and 18 in response to the urging of spring 45 against drive plate 42. Lever 32 has a handle 47 to facilitate the manual movement thereof relative to frame 11, and a cross member 49 which rests in notches 50 formed in frame 11 when the lever is in its finally closed position (as shown in FIGS. 1–3). This engagement between the lever and the frame transfers some of the load from the frame to the lever and thus effectively increases the load capacity of the device by combining the structures of the lever and the frame in handling loads placed on the device by the tensioned strap 35. Projections 21 are formed along the inner edges of lever arms 34 and 36, these projections having camming surfaces 22** along their outer periphery.

Figure 4:
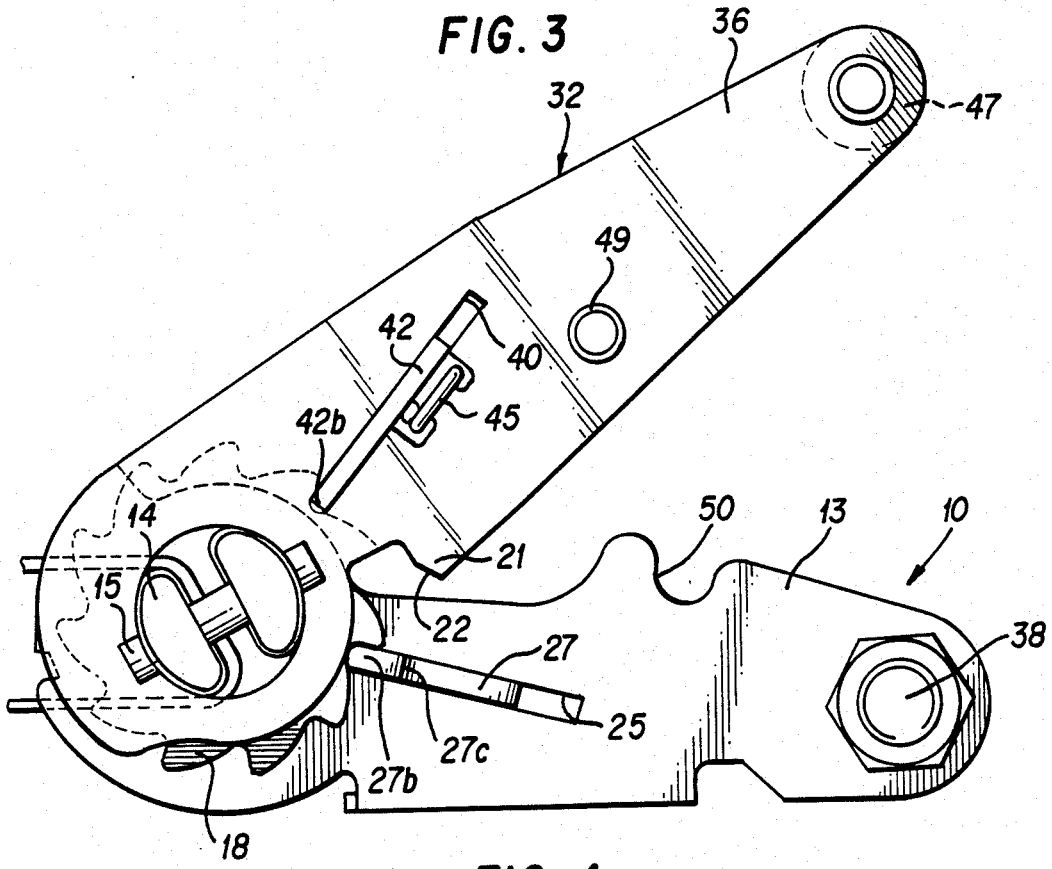
FIG. 4 is a side elevational view of the ratchet buckle of FIG. 1, shown while being employed to tension a strap component.

In operation, strap 35 (and the attached cable) is tensioned by raising and lowering lever 32 relative to frame 11, ratchet drive plate 42 driving the ratchet wheels as shown in FIG. 4 as the lever is moved upwardly, latching plate 27 retaining the ratchet wheels in position while the lever is moved downwardly over the arcuate portions of the ratchet wheel teeth. When the finally tensioned condition is reached, lever 32 is placed downwardly in the closed (locked) position shown in FIG. 2. As the lever enters this position, camming surfaces 22 formed at the extremities of securing projections 21 abut against latching surfaces **27*c* formed in the latching plate and drive the arms 27*a* and 27*b* of the plate into firm engagement with the ratchet wheels. Once driven into this position,the latching plate is prevented from being unseated from its latched position against the ratchet wheels by securing projections 21, even in the face of high vibration and cyclic changes in tensioning. As already noted, in the closed position pin member 49 is seated in notches 50 which effectively joins the lever and the frame together insofar as tensile loads imparted by strap 35 are concerned. This provides a fail-safe means of tensioning and maintaining tension on the strap 35** and the attached net supporting cable.

In the preferred ratchet buckle of the above-described FIGS. 1–4, positive securing of the ratchet buckle in the finally tensioned condition is achieved in a simple yet highly effective manner by providing undercut portions in the outer surfaces of the arms of the latching plate, with which camming and securing projections formed on the arms of the lever engage when the lever is in the "down" or finally closed position. These camming and securing projections drive the latching plate arms positively to firmly seated positions in the ratchet wheel and retain these arms in the seated position even in the face of high vibration and cyclic changes in tensile loading. The transfer of a portion of the load from the frame member to the handle is achieved by providing a cross member which runs between the arms of the handle, which seats in notches formed in the arms of the frame when the lever or handle is in its final closed position.

The size and load capacity of the ratchet buckle 10 selected for use in a given assembly of the present invention may be determined with an appreciation of the required tension to be applied to a given game net and good engineering practice. Similarly, the width and tensile strength of the strap 35 may be determined with regard to the degree of tension to be applied. In general, a 2 to 4 inch wide strap fabricated from a non-elastomeric textile webbing is advantageous for carrying out the assembly of the invention.

Figure 5:
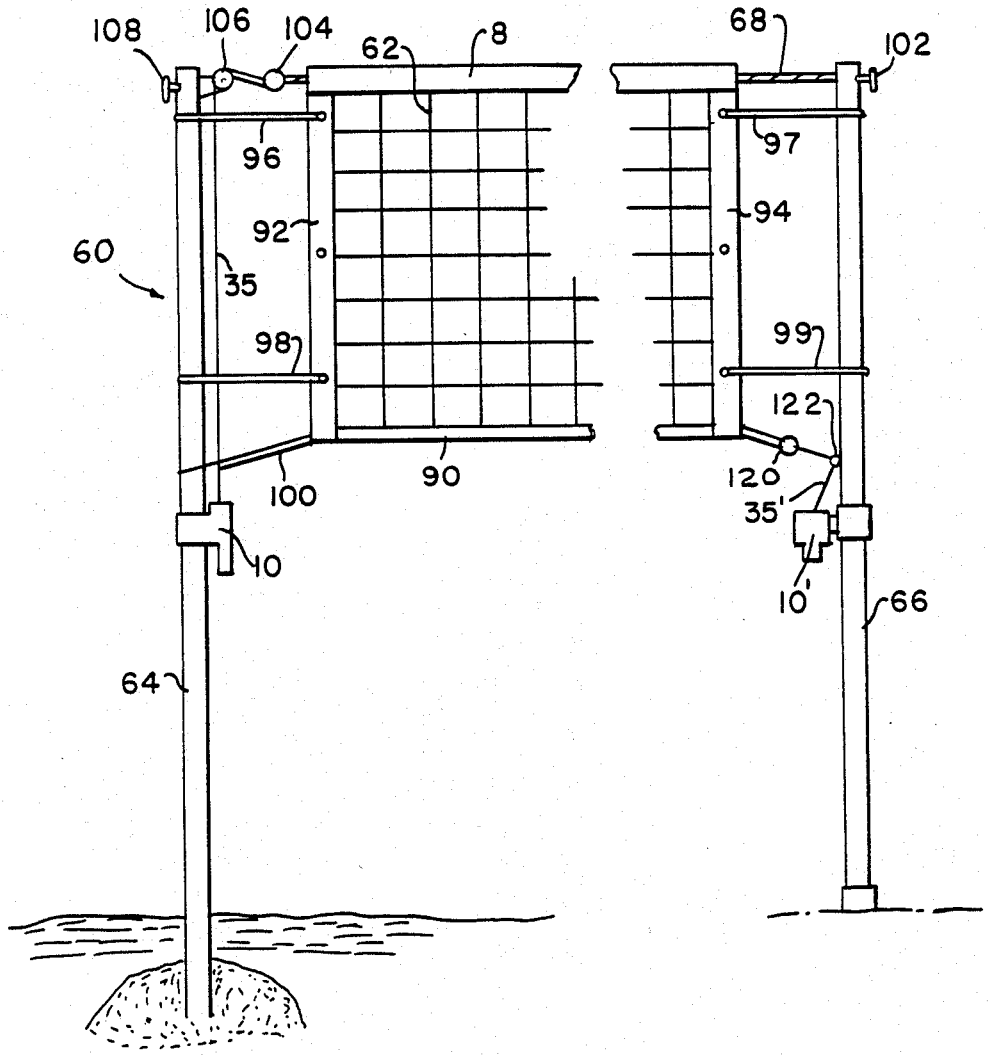
FIG. 5 is a fragmental view of a game net assembly of the invention, the assembly including the ratchet buckle of FIGS. 1–4, inclusive.

Referring now to FIG. 5, there is seen a fragmented view of a game net assembly 60 of the invention. The assembly 60 consists of a regulation volleyball net 62 suspended between upright supports (posts) 64, 66 on a suspension cable 68. The supporting cable 68 is partially enclosed by a headband 80 on the top edge of net 62. A footband 90 is on the lower edge of net 62 and marginal edge bands 92, 94 complete the dressing of the perimeter of net 62. Ties 96, 97, 98 and 99 tension the net 62 by securing the margin tapes 92, 94 to the adjacent upright support 64 or 66. A lower tensioning cable 100 is threaded through the footband 90. All of the cables 68, 100 and ties 96, 97, 98 and 99 are nonelastomeric so that variations in tensioning of net 62 during use are minimal once the net is tensioned as described herein.

A first end of the cable 68 is secured to the upright support 66 at the upper end 102. The second end of the cable 68 is secured to a ring coupler 104. The ring coupler 104 is also connected to the free end of strap 35 previously described as a component of the ratchet buckle 10. The ratchet buckle 10 is anchored to the upright support 64 at a convenient height for operation. The flat strap 35 passes on a vertical axis parallel to the upright support 64 between ties 96, 98 and turns to a horizontal plane coextensive with the axial plane of the support cable 68, on roller 106 before attachment to the ring 104. The roller 106 is positioned at the end 108 of the upright support 64. It will be observed that the support cable 68 does not come in contact with the roller 106 and thereby avoids twisting or kinking, as commonly occurs when support cables such as cable 68 are forced to pass over rollers, winch capstans or pulley wheels. The device of the coupling ring 104 functions to absorb rotational forces directed at the cable 68, which would serve to twist or kink the cable. The flat strap 35 is much more adaptable for passage over a roller such as roller 106 without twisting. In operation, ratchet buckle 10 can be operated as previously described to exert tension on the cable 68 as a fail-safe tensioning means. The tension on cable 68 prevents sagging of net 62, especially at the middle thereof.

A first end of the cable 100 is secured to upright support 64 at a point slightly below the plane of the footband 90 so that when the cable 100 is placed under tension it tends to pull downward upon and tension the net 62 in a vertical direction. The opposite end of cable 100 is secured through the agency of a ring 120 coupling, to the free end of a strap 35' which is a component of a second ratchet handle 10' (the strap 35' is identical to strap 35 and ratchet buckle 10' is identical to ratchet buckle 10 as previously described). The second ratchet handle 10' is secured to the upright support 66 at a height convenient for operation. The free end of strap 35' of the second ratchet handle 10' runs parallel to the upright support 66 before it passes over a roller 122 fastened to the upright support 66 at a point slightly below the plane of footband 90 and to change the direction of the strap 35' to run substantially parallel and coextensive with the axial direction of cable 100. The ring 120 coupler functions to prevent transmission of any twist developed in the cable 100 or strap 35', to the other of the cable 100 and strap 35'.

It will be appreciated from the above description that the assembly of FIG. 5 tensions the net 62 in vertical and horizontal directions without the use of elastic tensioning devices, and is a fail-safe means of doing so.

It will be appreciated by those skilled in the art that although the preferred embodiment described above concerns a volleyball net assembly, the invention is not so limited. For example, the ratchet handle 10 including its component strap 35 may be emplaced to tension the supporting cable of a lawn tennis net. In this instance, a second ratchet handle 10' is not required to place tension on the lower footband or margin of the net.

What is claimed is:

1. A game net assembly which comprises:

a net adapted by size and configuration to meet the requirements of play in a ball game, said net having a top edge, a bottom edge, a first side edge and a second side edge, said side edges being spaced apart from each other and joining the top edge to the bottom edge;

a headband attached to the top edge and extending between the first and the second side edges;

a net support cable disposed on a substantially horizontal axial plane and secured to the top edge of the net, said cable having a first end and a second end;

a first upright support positioned adjacent to the first side edge of the net, said upright support having a first end anchored to a support surface and a free second end;

the first end of the support cable being secured to the free end of the first upright support;

a second upright support positioned adjacent to the second side edge of the net, said second upright support having a first end anchored to a support surface, and a second end;

a ratchet buckle mounted on the second upright support and coupled to the support cable second end, by a first end of the strap component of the ratchet buckle;

said ratchet buckle comprising:

a frame member with a pair of oppositely positioned arms;

a reel member rotatably supported between said arms;

a pair of ratchet wheels being rotatably mounted between said arms and fixedly attached to said reel member in spaced apart relationship;

a latching plate slidably mounted between said arms for latching said ratchet wheels when they are not being rotatably driven;

a non-elastomeric strap having a second end wound around said reel member;

a lever member having a pair of oppositely positioned arms rotatably mounted on the reel member; and a ratchet drive plate slidably mounted between the lever member arms which engages and drives said ratchet wheel when the lever member is actuated.

2. The assembly of claim 1 wherein the ratchet buckle includes means for securing the latching plate in position firmly against the teeth of said ratchet wheels when the lever member is in a predetermined finally closed position relative to the frame member, comprising:

undercut portions forming latching surfaces in the outer edge portions of said latching plate, said surfaces facing in a direction substantially opposite to that in which the latching plate extends towards said ratchet wheels, and projections formed along the inner edges of the lever arms, said projections being positioned directly opposite said latching surfaces and having camming surfaces formed along the outer periphery thereof, said camming surfaces extending at an angle away from the latching surfaces with the lever member in said predetermined finally closed position.

3. A tennis net assembly which comprises:

a net adapted by size and configuration to meet the requirements of tennis play, said net having a top edge, a bottom edge, a first side edge and a second side edge, said side edges being spaced apart from each other and joining the top edge to the bottom edge;

a headband attached to the top edge and extending between the first and the second side edges;

a non-elastomeric net support cable disposed on a substantially horizontal axial plane and secured to the top edge of the net, said cable having a first end and a second end;

a first support post positioned adjacent to the first side edge of the net, said post having a first end anchored to the ground and a free second end;

the first end of the support cable being secured to the free end of the first post;

a second support post positioned adjacent to the second side edge of the net, said second post having a first end anchored to the ground and a second free end;

a ratchet buckle mounted on the second upright support post between the first and second end;

said ratchet buckle comprising:

a frame member with a pair of oppositely positioned arms;

a reel member rotatably supported between said arms;

a pair of ratchet wheels being rotatably mounted between said arms and fixedly attached to said reel member in spaced apart relationship;

a latching plate slidably mounted between said arms for latching said ratchet wheels when they are not being rotatably driven;

a non-elastomeric strap having a first end wound around said reel member, leaving a second end of the strap free;

a lever member having a pair of oppositely positioned arms rotatably mounted on the reel member; and a ratchet drive plate slidably mounted between the lever member arms which engages and drives said ratchet wheel when the lever member is actuated;

the portion of said strap not being wound around the reel being tensioned vertically upward from the ratchet buckle to the free second end of the second post and then on a horizontal plane coextensive with the plane of the support cable;

the second end of the strap being coupled to the second end of the support cable; and means mounted on the free end of the second post for supporting the strap at the point where it is disposed on a horizontal plane.

4. A volleyball net assembly which comprises:

a net adapted by size and configuration to meet the requirements of volleyball play, said net having a top edge, a bottom edge, a first side edge and a second side edge, said side edges being spaced apart from each other and joining the top edge to the bottom edge;

a headband attached to the top edge and extending between the first and the second side edges;

a footband attached to the bottom edge;

a net support cable disposed on a substantially horizontal axial plane and secured to the top edge of the net, said cable having a first end and a second end;

a lower cable disposed on a substantially horizontal axial plane and secured to the bottom edge of the net, said lower cable having a first end and a second end;

a first upright support positioned adjacent to the first side edge of the net, said upright support having a first end anchored to a support surface and a free second end;

the first end of the support cable being secured to the free end of the first upright support;

the second end of the lower cable being secured to the first upright support;

a second upright support positioned adjacent to the second side edge of the net, said second upright support having a first end anchored to a support surface and a second end;

a first ratchet buckle mounted on the second upright support and coupled to the support cable second end, by the strap component of the ratchet buckle;

a second ratchet buckle mounted on the first upright support and coupled to the lower cable first end by the strap component of the second ratchet buckle;

said ratchet buckles each comprising:

a frame member with a pair of oppositely positioned arms;

a reel member rotatably supported between said arms;

a pair of ratchet wheels being rotatably mounted between said arms and fixedly attached to said reel member in spaced apart relationship;

a latching plate slidably mounted between said arms for latching said ratchet wheels when they are not being rotatably driven;

a non-elastomeric strap having a first end wound around said reel member and a second end free for coupling to a cable;

a lever member having a pair of oppositely positioned arms rotatably mounted on the reel member; and a ratchet drive plate slidably mounted between the lever member arms which engages and drives said ratchet wheel when the lever member is actuated.

* * * * *